US006062433A

United States Patent [19]

Fuchs

[11] Patent Number: 6,062,433

[45] Date of Patent: May 16, 2000

[54] TECHNICAL FIELD AND BACKGROUND OF THE INVENTION

[75] Inventor: Karl-Heinz Fuchs, Radolfzell, Germany

[73] Assignee: Ing. Erich Pfeiffer GmbH, Radolfzell, Germany

[21] Appl. No.: 09/148,361

[22] Filed: Sep. 4, 1998

[30] Foreign Application Priority Data

Sep. 11, 1997 [DE] Germany ..... 197 39 989

[51] Int. Cl.[7] ..... B67D 5/33; G01F 11/36

[52] U.S. Cl. ..... 222/153.13; 222/321.6

[58] Field of Search ..... 222/153.01, 153.13, 222/321.1, 321.6, 321.7, 321.9, 383.1, 385, 402.1, 384

[56] References Cited

U.S. PATENT DOCUMENTS

| | | | |
|---|---|---|---|
| 3,391,647 | 7/1968 | Corsette et al. | 103/188 |
| 4,694,977 | 9/1987 | Graf et al. | 222/259 |
| 4,934,568 | 6/1990 | Fuchs | 22/153.13 |
| 5,335,823 | 8/1994 | Fuchs et al. | 222/153.13 |
| 5,377,881 | 1/1995 | Jouillat | 222/321 |

FOREIGN PATENT DOCUMENTS

| | | |
|---|---|---|
| 77 22 792 | 7/1979 | Germany . |
| 296 22 983 U1 | 7/1996 | Germany . |
| 19627228 A1 | 8/1998 | Germany . |
| 749691 | 5/1956 | United Kingdom . |

OTHER PUBLICATIONS

German search report in Appln. No. 197 39 989.4, dated Apr. 20, 1998.

*Primary Examiner*—Kevin Shaver
*Assistant Examiner*—Keats Quinalty
*Attorney, Agent, or Firm*—Quarles & Brady LLP

[57] ABSTRACT

For upside-down operation a metering pump (8) is provided with a displaceable cylinder (16) and a valve (19) located directly at a droplet delivery orifice (15). Vent (70) for a reservoir (6) comprise a germ filter (71). For venting the medium spaces (12, 13) actuator (20) are provided which on the return stroke of the outlet valve (19) briefly crack open. For operation in the upright normal position a suction tube may be applied to the inlet (45) of the dispenser (1).

26 Claims, 1 Drawing Sheet

TECHNICAL FIELD AND BACKGROUND OF THE INVENTION

TECHNICAL FIELD AND BACKGROUND OF THE INVENTION

The invention relates to a dispenser with which flowable or other media, for example liquid, pasty powdery or gaseous media can be stored, delivered or discharged at a medium outlet to separate from the dispenser. The dispenser may be freely carried by the user in one hand and simultaneously actuated by the same hand, i.e. single-handedly with a force conveying the medium.

The dispenser may be configured for refilling its pressure chamber with the medium, for example from a medium reservoir and suck the medium on the return stroke. The dispenser may also be a single-use dispenser to be actuated via but a single pump stroke oriented only in a single direction and containing the full medium volume stored in its pressurizing chamber right from the start. This medium may also then be discharged metered by a single stroke or by a sequence of partial strokes from the pressure space. The pressure chamber housing can be provided on the unit which is movable or shiftable with the medium outlet.

OBJECTS OF THE INVENTION

An object of the invention is to obviate the disadvantages of known configurations. Another object is to ensure precise or variable metering whilst providing non-tiltable bearing of its dispenser units, a tight seal, a substantially smooth outer surface or high functional reliability.

SUMMARY OF THE INVENTION

According to the invention means are provided for defining a stroke path, for mechanically positively controlling a flow or pressure compensation by manual actuation valve, for combining elements to an assembly unit for connecting the dispenser to a support body, for sealingly engaging the two dispenser units apart from the pressure chamber and/or for preventing germ contamination of the medium. Thereby the discharge volume of each stop-limited working stroke or stroke path can be precisely defined or varied. Furthermore the dispenser can be simply secured to the carrier, for example a bottle whilst enabling to be adapted to different bottle shapes. Furthermore residuals of the medium at the medium orifice can be sucked back into the dispenser behind the valve seat of an outlet valve at the end of media discharge whilst de-aerating the pressure chamber. Also ingress of foreign substance, such as germs or dirt into the dispenser is prevented by simple means.

Means are provided for discharging the medium with the dispenser in the upside-down position. In the upside-down position the final medium outlet is oriented downwards and located below the press chamber or dispenser. Furthermore, means are provided so that the medium emerges from the medium outlet in a precisely premetered amount non-atomized, i.e. as a droplet. This droplet then detaches as a whole from the medium outlet, namely from the bound edge thereof. Individual dispenser parts or fully assembled dispensers can be sterilized, cold where necessary, for example by gamma radiation.

The flow valve may be provided separately from the stop means or connected thereto, e.g. by sealed guidance of a movable valve element at one of the stop members. This stop member may be inserted together with the valve element as a preassembled unit into the second base body or discharge head. The first dispenser unit contains a freely protruding driver connected to the valve body via a snap-action coupling engaging and disengaging exclusively force-dependent whilst translating the valve body positively into the desired valve position, for example the open position. Thereafter the coupling is reseparated force-dependent and the valve body returned to its other valve position by spring force. In this way, air is able to flow out, e.g. via the medium outlet and the outlet duct, from the press chamber during only a first portion of the return stroke of the dispenser.

The dispenser comprises a fastener, like an annular disk-shaped flange for a crimp ring or a cap for its connection to the reservoir. Connecting members protrude from the inner side of this fastener, e.g. a riser or suction tube freely protruding into the reservoir, a seal, a fastener element for positively engaging the dispenser and/or a body bounding the press chamber. At least two up to all thereof form a preassembled or one-part unit to be fixed to the dispenser or to the first base body. Accordingly, by changing this unit the dispenser can be adapted to greatly different shapes of the reservoir or to the flow properties of various media. To bound the press chamber e.g. a cylinder jacket and a plunger are provided, each of which may belong to the cited unit. However, this bound may also bound other medium spaces and where necessary form the driver or a coupling member of the valve actuator. For upside-down operation the riser tube is not provided so that in the upside down position the medium is able to flow directly into the press chamber by inclination, i.e. irrespective of to what degree the reservoir is filled.

The second dispenser unit provided as actuator unit is sealingly guided at the first dispenser unit by circumferential faces or the like such as sliding faces in such a way that inner spaces of the dispenser located outside of the press chamber are sealed off from the environment. The seal is provided in the vicinity of multiple, separate annular zones formed by nested, shell-shaped projections which are radially spaced from each other. Thereby separate, nested annular spaces are achieved which are sealed from each other in the rest or initial position and/or over the stroke path. Thus an outermost shell can be provided with a window-type port for guiding a cam or the like without dirt being able to enter beyond the next projection located in this outermost shell.

Also means are provided for de-aerating the medium spaces, like the pressurizing chamber, the medium outlet and all medium spaces adjoining each other inbetween to permit quickly filling these medium spaces with medium by a priming action on first-time operation of the dispenser. For that the valve actuator as explained is suitable which maintains the outlet valve open over a partial path of the return stroke so that the compressed air can easily emerge without having to also maintain the outlet valve open against a valve spring. Venting the medium reservoir for equalizing the pressure for the amount of medium discharged in each case can be achieved via a further valve which is opened or closed by manual actuation. For example, it may be closed in the rest position of the dispenser and open in all other stroke positions. The vent duct passing through the valve may then entirely bypass the medium spaces.

BRIEF DESCRIPTION OF THE DRAWINGS

Example embodiments of the invention are explained in more detail in the following and illustrated in the drawings in which.

DETAILED DESCRIPTION

Figures 1, 2, 3:
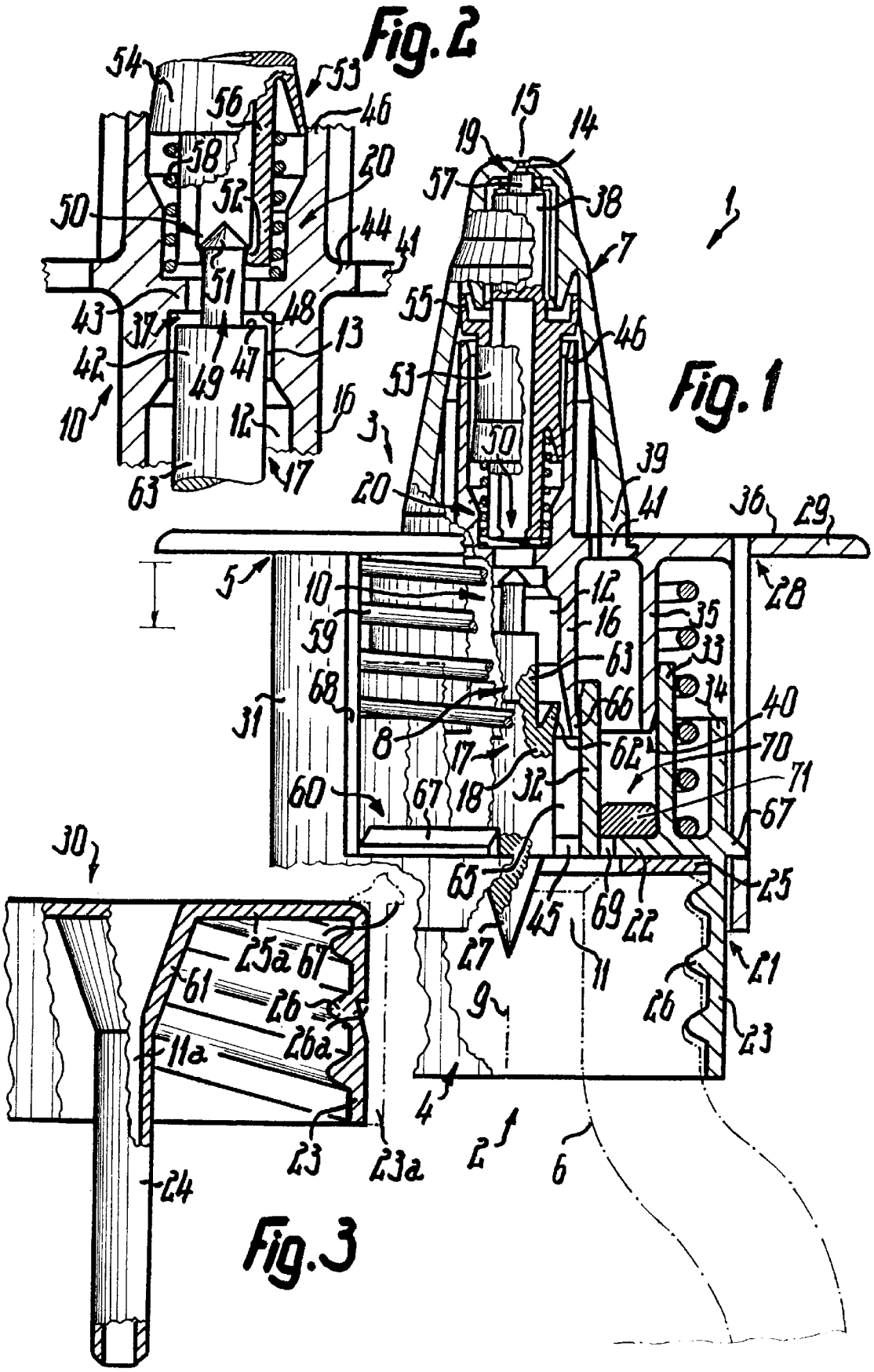
FIG. 1 illustrates a dispenser according to the invention partially in a side view, partially in axial section and in the rest position of the discharge actuator.
FIG. 2 is a sectional view on a magnified scale taken from FIG. 1 but shortly after commencement of the return stroke.
FIG. 3 is a further embodiment of the reservoir connection.

The dispenser 1 comprises first and second dispenser units 2, 3 movable linearly and axially relative to each other. Each comprises an integral base body 4, 5. Dispenser 1 is devised for being secured to a carrier or medium reservoir 6 which then forms a component of first unit 2 or of first base body 4 and which may also be configured integrally with the latter.

Second base body 5 of second unit 3 comprises a discharge head 7 which may be in one part with base body 5, but is here a separate, oblong cap-shaped component. Totally encapsulated within bodies 4, 5 is a medium pump 8, namely a thrust piston pump with which the medium is sucked abruptly from the reservoir 6 on its return stroke and then discharged on the working stroke. From the rest position units 2, 3 are to be moved relative to each other manually over the working stroke up to the stroke end against spring force so that the dispenser 1 is shortened. The cited parts are located in a central dispenser axis 9. Where necessary, except for springs, such as return springs, all components of the dispenser 1 may be made of a plastic material, e.g. as injection molded components.

Stop or valve means 10 serve to precisely define and to vary the amount of medium discharged by the corresponding working stroke. The end of the working stroke is stop-limited and the amount of medium discharged is varied by altering the length of the stroke path. The working stroke following in each case may connect codirectional to the end of the preceding working stroke if no return stroke or no return spring is provided. At the end of each working stroke the dispenser 1 may also be returned to its rest position likewise defined by a stop and then reactuated over the next working stroke. Means 10 are located totally in unit 3 or in base body 5 so that unit 2 can be easily replaced.

Extending juxtaposed from reservoir 6 up to a medium outlet 15 are medium paths or medium spaces internally passing through units 2, 3 symmetrically to axis 9. Protruding from base body 4 freely and counter flow direction into reservoir 6 is an inlet duct 11*a* shown in FIG. 3. Duct 11*a* issues by an annular passage section into an annular pressure or pump chamber 12 of metering pump 8. In upside-down operation the reservoir neck bounds inlet duct 11 from which the medium flows through the neck opening directly into bodies 4, 5. Chamber 12 comprises an axial section having enlargened flow cross-sections and an axial section 13 directly adjoining the latter in the flow direction which has smaller flow cross-sections as the connecting duct. Adjoining the latter in flow direction is an again narrower axial section which in the vicinity of a duct closure connects to an outlet duct 14 in flow direction. Duct 14 is formed exclusively by a nozzle duct of an atomizer nozzle which forms by its downstream end outlet 15. Duct 14 is bounded in one part and traverses only a single end wall of head 7. As a result duct 14 is exceptionally short, it having a length which is maximally two or three times more than its largest width.

As chamber bounds pump 8 comprises a cylinder 16 and a plunger unit 17 with a plunger 18 sealingly shiftable in cylinder 16. Cylinder 16 is fixedly or in one part connected to base body 5 and freely projects counter flow direction into body 4. Piston 17 is fixedly or in one part connected to body 4 so that unit 17 projects freely in flow direction into body 5. Unit 17 may be secured and axially supported on body 4 upstream of piston 18 in the vicinity of only a single end face. Unit 17 may also be formed by a separate component inserted in or counter flow direction in the body 4 and rigidly fixed thereto.

The cited duct closure is formed by an outlet valve 19 opening and closing as a function of pressure up to the valve seat of which the press chamber 12 may extend valveless. The valve seat is formed by the inner face of the cited end wall of head 7 and is thus located at the inner end of duct 14. In addition to actuating the valve as a function of pressure, actuating means 20 are provided for automatically or positively open valve 19 on commencement of the return stroke and to reclose it during the remaining portion of the return stroke by spring force. During this valve opening air is able to exhaust through ducts 14, 15 from spaces 12, 13 into the open whilst piston 18 still tightly seals off chamber 12.

Once medium spaces 12 to 14 are then filled completely with non-compressible medium, opening the valve serves to suck the medium back from ducts 14, 15 into the dispenser. As a result medium residuals and where applicable a small amount of air are brought behind the closure 19 into chamber 12 whilst entirely emptying duct.

Body 4 forms a fastening flange or a cap 21 having an end wall 22 and a jacket 23 in which the constricted neck of reservoir 6 is axially fixedly located and tensioned. A riser tube 24 freely projects counter flow direction from the inside of end wall 22 into the reservoir 6 as shown in FIG. 3. Tube 24 bounds in one part the upstream end part of duct 11*a* from its inlet opening up to wall 22. Conduit 24 may be in one part with body 4 or can be a separate component which is inserted in flow direction into cap 21 linearly and then directly supported by wall 22 beyond which it does not project in flow direction. Adjoining the inside of wall 22 is also an annular disk-shaped seal 25 which is axially tensioned between wall 22 and the end face of the reservoir neck whilst being in one part with tube 24. In FIG. 1 no tube 24 is provided for upside-down operation so that the liquid is directly available at the inside of wall 22 in the upside-down position.

Located at the inner circumference of jacket 23 is a fastening member 26 projecting radially inwards, for example a screw thread, an annular snap-action cam or the like which for mutually tensioning bodies 4, 6 axially positively engages a counter member at the outer circumference of the reservoir neck and may be spaced from both ends of jacket 23. Member 26 is in one part with body 4 but may also be in one part with tube 24 or seal 25 as shown in FIG. 3. The outer circumference of member 24, 25*a* then transits into jacket 23 oriented counter flow direction which adjoins the inner circumference of jacket 23 of FIG. 1 and is connected thereto axially fixedly via a resilient snap-connector 26a. The snap-cam of connection 26*a* protrudes radially inwards from jacket 23 and/or from the outer circumference of inner shell 23 and positively engages in each case in a snap-detent of the opposing circumferential face. With shell 23 the dispenser 1 may be mounted on a reservoir neck with a screw thread and, without shell 23 on a reservoir neck having a snap-member which is engaged fixedly by the snap-member of shell 23*a*. Wall 22 may also be an annular disc flange without shell 23 or be secured to the reservoir neck by a crimp ring. Furthermore, the snap-member may be provided on shell 23 and thread 26 on shell 23*a*.

A core or guide body 27 freely protrudes counter flow direction from the inside of wall 22 to engage inside the reservoir neck, and duct 11*a* of FIG. 3. Over the length of body 27 the reservoir neck or duct 11 is annular. Body 27 is tapered acutely conically counter flow direction and the jacket of tube 24 is flared in flow direction with the same conical angle in this portion. Thereby between the widest end and body 25 a passage is formed which traverses body 25. Thereby, as shown in FIG. 3, flow cross-sections of duct 11*a*are widened in flow direction along projection 27 and up to chamber 12. As evident from FIG. 1, the flow cross-sections can continuously restricted up to approximately wall 22. The parts 24, 25*a*, 23, 26, 61 form a preassembled unit 30 to be fixed to body 4 and axially locked by snap-connector 26*a*. Unit 17 may belong to unit 30. As evident from FIG. 1 projection 27 bounds with the cylindrical inner circumference 11 of the reservoir neck a duct section which in flow direction is first restricted before then bounding up to wall 22 a duct section which is substantially shorter and widened. From the dispenser 1 only the projection 27 protrudes into the reservoir 6.

Also body 5 forms a cap 28 for receiving the downstream end of body 4. This cap 28 comprises an end wall 29 and a jacket 31 freely projecting therefrom exclusively counter flow direction. In shell 31 body 4 is permanently engaged in a snug fit. Projecting from wall 22 exclusively in flow direction are three jacket projections 32, 33, 34 spaced from each other radially and located coaxially nested. Sleeve-shaped shells 32 to 34 are in one part with body 4. Inlet ports 45 pass through wall 22 from the inner circumference of shell 32 up to the cylindrical outer circumference of piston 18, these ports being directly connected to passage 11 or 11*a*.

Projecting from wall 29 exclusively counter flow direction are three jacket projections or sleeve-shaped shells which are likewise radially spaced from each other and coaxially nested. The innermost shell is formed by jacket 16 and the outermost shell is formed by the cap shell 31. Shell 35 is located between shells 16, 31. All shells 16, 31, 35 are in one part with body 5. The axially mostly protruding one of shells 32 to 34 is middle shell 33, it being the outermost shell 34 that protrudes least. Shell 34 may have the same outer and inner width as shell 23.

From end wall 29 stud 7 projects in flow direction thus that wall 29 radially outwardly projects over stud 7 only on two opposing sides each other or on all sides. Shell 39 of head 7 may coincide with one of shells 16, 31, 35. Around shell 39 the outer side of wall 29 forms a pressure handle 36 possibly projecting radially outwards beyond shell 31 or extending only up to shell 31 or 39. Furthermore, it may surround members 20, 41 to 44, 46, 49, 52, 53 or 58. Shell 39 envelopes control body 38.

The upstream end of body 7 forms shell 39 having cylindrical inner and outer circumferences permanently engaging wall 29 and fixedly or in one part connected with the remote end wall of head 7. Via guiding or sealing means 40 bodies 4, 5, 7 mutually permanently engage movably so that no air can enter medium spaces 12, 13 except via the duct 11 or port 15. Instead via a duct completely bypassing medium spaces 11 to 15 atmospheric air is able to flow into the constant-volume reservoir 6 through bodies 4, 5.

Bodies 5, 7 are secured axially and radially tensioned to each other by a snap-connector 41. The circumferentially distributed snap-members thereof are in one part with the end of shell 39 and the counter members thereof pass wall 29 as separate snap-openings. Head 7 can be non-destructively detached and removed from the snap-connector 41 by resiliently constricting shell 39. Head 7 is conically tapered at an acute angle toward outlet 15 located in axis 9. Head 7 can be introduced into a bodily or nasal opening or can dispense a medical treatment medium into the open eye, this requiring the dispenser 1 to be used upside down.

Stop means 10 comprise two stop members 42, 43 which mutually engage continuously displaceable parallel to axis 9 and which may be mutually rotatable or non-rotatable about axis 9. Stop member 42 constricted relative to the plunger travel of cylinder 16 is formed by unit 17 and thus axially fixedly connected to body 5. Stop member 43 is formed by a body separate from head 7 or shell 39, but fixedly connected both axially as well as about axis 9 to shell 39, with which it could also be in one part. Member 43 forms an annular disk-shaped wall projecting radially inwards through which duct 13 passes, further constricted, before then porting into a widened calming chamber.

Unit 2, 4 forms near to the downstream end of unit 17, 42 an annular stroke stop 47 to which on body 5, 7 or 43 an annular counter-stop 48 is associated. So by mutually abutting shoulder faces 47, 48 the maximum stroke path or length of the working stroke is defined. Faces 47, 48 are located in axis 9 or exclusively within bodies 5, 7 as well as permanently in the vicinity or upstream of wall 29. Faces 47, 48 are located in chamber 12, namely connecting downstream directly to duct 13. Their mutual idle spacing is axially adjustable by positioning means. In a single-use dispenser such positioning means could comprise, instead of a fine thread, a coarse pitch thread or a stepped connecting link for dividing the stroke as a whole into individual, stop-defined stroke portions.

At its outer circumference stop member 43 transits into a flared annular collar 44 fixedly engaging the inner circumference of shell 39 or wall 29 and in one part with wall 29. From the upstream end of sleeve-shaped member 43 a sleeve projection 45 projects freely toward piston 18 through wall 29 and into shell 16. The end face of this projection permanently directly opposes the end face of piston 18, but without coming up against the plunger even at the end of the stroke. The inner circumferential face of sleeve 16 is constricted by steps up to stop 48 and bounds duct 13.

In flow direction a sleeve projection 46 juts from collar 44, 29 without contact into the tapered section of shell 39 which like sleeve 16 is longer than its outer width. Sections 16, 43, 44, 46 are axially fixedly interconnected or in one part.

Axial ribs or the like on the outer circumference of shell 46 may bear equispaced on the inner circumference of shell 39 for radially tensioning and centering sleeve 46.

For briefly opening and automatically closing valve 19 a slave actuator or driver 49 is provided on unit 5, 17 and formed by the downstream end of unit 17. In the rest position driver 49 is located entirely within sleeve 16, i.e. in the initial position of units 2, 3 as a core body within the widened section of chamber 12 which it bounds annularly in the center exclusively upstream of member 49. Driver 49 comprises a counterhooking-type snap-member 51 of a drive or snap-coupling 50. The second coupling or snap-member 52 thereof is provided on the axial reciprocatingly shiftable valve body 53 of valve 19.

Valve body 53 comprises two seal or piston lips 54, 55 mutually axially spaced, counterdirectionally freely protruding and annular. The upstream located and directed lip 54 bounds the cited calming chamber and slides permanently sealed on the inner circumference of sleeve 46. The downstream located and oriented lip 55 slides permanently sealed on the inner circumference of shell 39 and bounds a further, widened calming chamber. The end wall of lip 55 may form a stop which on valve opening comes up against the end face of sleeve 46, thereby defining the maximum opening travel of valve 19.

The upstream end of body 53 comprises a sleeve-shaped finger or mandrel 56 freely projecting upstream from lips 54, 55 counter flow direction towards member 43 and driver 49, thus opposing the latter permanently directly with snap-member 52. Member 52 projects as an annular cam radially inwards beyond the inner circumference of finger 56 with which it is resiliently spreadable. Member 52 is located directly adjacent to wall 43 located between bodies 16, 46 or 47, 52. The upstream end face of wall 43 facing away from member 52 forms within collar 44 stop 48. Wall 43 is traversed by a constricted port which is further constricted when member 49, 51 passes through. It is not before the pumping stroke that driver 49 is moved through this port in a snug fit by its snap-member 51 until the dimensionally rigid snap-member 51 first latches into engagement with member 51. Thereafter, as soon as faces 47, 48 abut against each other they close—as a valve 37 which is otherwise always open—the upstream section of press chamber 12, the volume of which is accordingly reduced so that valve 19 closes instantly.

On start of the return stroke driver member 51 executes a short idle travel relative to member 52, right then abuts against member 52, takes along body 53 counter flow direction and thereby opens valve 19 up to abutment. Connecting thereto and after the smaller portion of the return stroke member 51 is torn out of member 52 by the axial return forces. Member 52 is thereby resiliently widened. On being released by member 51 valve element 53 is returned by a spring 58 in flow direction flow, whereby valve 19 is closed.

The return forces for units 2, 3 are caused by a spring 59, like a coil or compression spring, which is located totally remote from medium spaces 11 to 15 and engages between shells 33, 34 as well as 31, 35 so that its ends are directly supported against walls 22, 29. Spring 59 could also be in one part with at least one of members 16, 17, 32, 58. Then coil or compression spring 58 surrounds the axially slotted mandrel 56 and member 52. Spring 58 is then permanently supported with pretension with one end on wall 43 and with the other end within lip 54. Spring 58 protects members 52, 56 from excessively widening and may also be in one part with members 38, 53, 54, 55, 56, 57 in a plastic material or the like. Then the dispenser may consist of but four components 4, 5, 7, 53.

Downstream of lip 55 body 53 comprises a mandrel which is slimmer than lip 55, which projects in flow direction freely within shell 39 and which transits at the end into an even slimmer mandrel or end section 57 forming the movable closing face of valve 19. This annular closing face is flanked as a sharp-angled edge by the cylindrical circumferential face and the planar end face of mandrel 57. In the closing position the exclusively linearly movable closing face is in contact with the valve seat formed by the inner face of the end wall of head 7.

Sections 54 to 57 are axially fixedly connected to each other and in one part with valve body 53. The flow path of the medium passes axially through body 53 up to the interior of lip 55 and then emerges radially into the interior of lip 55, from which it is guided further along the outer circumference of mandrel 38 to the valve seat. This section of the flow path is bounded by the outer circumference of mandrel 38 and by the inner circumference of shell 39. Directly adjoining the valve seat upstream thereof flow calming or swirler or vortex means are provided with a calming or vortex chamber. These means have guide ducts oriented radially inwards to port into a central chamber. This chamber and the guide ducts are bounded by the annular end face of mandrel 38, the circumference of mandrel 57, shell 39 and the inside of the end wall of head 7. By means of this swirler the medium is finely atomized on leaving outlet 15. For droplet discharge the swirl chamber is replaced by the calming chamber having flow cross-sections substantially larger than the upstream and downstream adjoining duct sections. Enlargening this chamber merely requires mandrel 57 to be lengthened or the mandrel 38 to be shortened. Once head 7 has been removed in flow direction bodies 46, 53 are freely accessible.

To mutually lock units 2, 3 or bodies 4, 5 against axial separation and against mutual rotation locking means 60 are provided. The locking members thereof are directly arranged on shells 23, 34 or 31. Thereby rotational orientation of unit 3 relative to reservoir 6 is always the same. Also withdrawal of unit 3 from unit 2 in flow direction is positively prevented solely by this lock 60. Corresponding withdrawal of head 7 from units 2, 3 is positively prevented solely by connection 41. Head 7 can thus be totally removed from unit 3 by pulling it off axially, e.g. for filling reservoir 6 with medium through cylinder 16.

Piston 18 has a single annular piston lip 62 freely projecting in flow direction and sealingly running on the inner circumference of cylinder 16. In the rest position lip 62 is lifted out of contact from the inner circumference because the latter is conically widened at an acute angle at its end and counter to flow direction. Freely projecting in flow direction within and beyond piston lip 62 is a cylindrical mandrel 63 of unit 17. Mandrel 63 bounds with its outer circumference medium spaces 12, 13 and carries at its downstream end stop member 43 and the reduced driver 49. Driver 49 freely projects from end face 47 of mandrel 63 by a slimmer mandrel section, at the end of which a widened and acutely angled conical head provides coupling member 51. Parts 18, 27, 43, 63, 49, 51 are axially fixedly connected to each other and may be in one part. Parts 43, 63 pass from face 47 up to lip 62 with constant outer cross-sections.

At the transition between piston 18 and body 27 unit 17 forms a ring shoulder located in the plane of the inside of wall 22 and partly covering the widened end of the annular section of duct 11. Thus a constriction or throttle point is achieved. According to FIG. 3 it is at this point that tube 24 forms a funnel end widened at an acute angle in flow direction. Relative to end 61 unit 17 may be free of contact. The upstream end of piston 18 may also be secured to at least one of bodies 4, 22, 24, 25, 32 by snap-members distributed about its circumference and bounding inlet opening 45 or vent opening 69 in wall 22. Thereby piston 18 can be in one part with shell 32.

By ring lip 62 and the inner circumference of cylinder 16 an inlet valve 64 is formed which in initial position is open and after a first part of the working stroke is closed due to lip 62 then running up against the conical section of cylinder 16. Adjoining this valve seat upstream is an annular suction chamber 65 bounded by piston 18 and shell 32. By its inlet end 45 presuction chamber 65, like shell 32, traverses end wall 22 and directly adjoins the annular end of duct 11 or 11*a* upstream. On closing valve 64 the working stroke causes the medium to be compressed in chamber 12 up to the control space within lip 55. Thus, once a limit pressure is exceeded valve element 53 is displaced against spring 58 and the medium discharged through opened valve 19 until the mechanically or manually actuated valve 37 closes at the end of the stroke.

The free end of shell 16 forms an annular piston or sealing lip 66 freely projecting counter flow direction, sliding on the inner circumference of shell 32 and bounding chamber 65 by its inner circumference. Lip 66 is located permanently upstream of lip 62. The sealing compression or expansion of lips 54, 55, 62, 66 increases with increasing medium pressure within medium spaces 11 to 14 so that a tight seal is assured. Lip 66 is in one part with shell 16. An equivalent sealing lip could also be provided by shell 35 for sealed guidance on the inner circumference of shell 33. Like shells 34, 31 also shells 33, 35 permanently over engage each other.

For providing venting means 70, air may also be fed between shells 33, 35 into the annular space between shells 32, 33 and from there through opening 69 or wall 22 and seal 25 into the reservoir 6. Thereby in rest position shells 33, 35 form a tight closure for this venting path. The closure may be a valve which is closed only in the rest position and open in all other stroke positions. Thereby one valve body is in one part with shell 33 and the other valve body in one part with shell 35. On the actuating stroke the pressure in the annular space between shells 16, 32, 33, 35 is slightly increased, whereby pumping action into reservoir 6 is achieved. Opening 69 adjoins the outer circumference of shell 32.

At the outer circumference of shells 23, 34 or of wall 22 body 4 comprises at least one radially projecting cam 67. Body 5 comprises in shell 31 through openings or windows 68 distributed circumferentially, extending from wall 29 up to the vicinity of the open cap end of cap 28 and traversing wall 29 as slots. One of cams 67 engages in each port 68 thus forming a resilient snap-connection with mutually displaceable snap-members 67, 68 for interconnecting bodies 4, 5. This snap-connection simultaneously forms lock 60 since cam 67 abuts against the upstream bound of window 68 at the end of the return stroke. Cam 67 is stationary relative to axis 9 and comprises an inclined shoulder which runs against the cap end of body 5 on assembly, then resiliently widens shell 31 before then snapping into place in port 68. Components 5 to 7, 16 to 18, 21 to 24, 26 to 29, 31 to 39, 42 to 49, 53, 56, 57, 61, 63 and 67 may be inherently or dimensionally rigid. Head 7 projects beyond wall 29 by a length which is at least equivalent to its outer diameter or multiply longer.

Seal 41 ends flush with the free end faces of projections 37, 38. If air for venting reservoir 6 needs to be germ-free, filter means or germicidal means are fixedly arranged in the venting path or in the annular space between shells 32, 33. For instance, a flat disk or ring-shaped germ filter 71 may adjoin shells 32, 33 radially tensioned and support with its end face against the outside of wall 22. Wall 22 at the junction to the outer side of shell 32 as well as seal 25 are traversed by vent opening 69 issuing into the reservoir space in the plane of wall 22 and covered by member 71. Filter 71 is e.g. a membrane filter and may be semi-permeable or such that it, like a seal, blocks the passage of medium from out of reservoir 6.

All features, properties and effects cited may be precisely or merely substantially or roughly as explained and may also greatly depart therefrom depending on the medium to be discharged. Partial bodies described as being in one part with each other may also be formed by separate components and connected to each other in their mutual transition or connecting zones by connecting members, e.g. by a weld, a snap-connection or the like. The discharge device may also be used for precisely discharging even minutely dispensed amounts, e.g. 5 $\mu$l.

Reference is made to U.S. Pat. No. 4,694,977; U.S. Pat. Appl. No. 08/628,603, filed Apr. 11, 1996; U.S. Pat. No. 5,884,814, issued Mar. 23, 1993; U.S. Pat. No. 5,927,559, issued Jul. 27, 1999 and German Utility Model No. 296 22 983.0, all of which are assigned to the assignee of the present invention, as disclosing further details of the dispenser of the present invention. Dispenser 1, the reservoir 6 or dimensionally rigid reservoir bound of which comprises but a single reservoir port, namely that for inserting unit 2 and has no drag piston, may be converted for upright operation simply by adding tube 24 with outlet 15 located above reservoir 6, since then the medium is sucked from the bottom zone of the reservoir through duct 11 directly into chamber 65.

What is claimed is:

1. A dispenser for discharging media comprising:

a dispenser base including first and second dispenser units (2, 3), said first dispenser unit (2) including a first base body (4) and said second dispenser unit (3) including a second base body (5);

a discharge actuator for displacing said second dispenser unit (3) with respect to said first dispenser unit (2) over an actuating stroke defining a stroke direction, a stroke path and a rest position;

medium spaces including a pressure chamber (12), an outlet duct (14) and a medium outlet (15) for discharging the media out of said medium outlet (15), said medium spaces (12, 14, 15) defining a flow direction for the media; and chamber bounds (16, 18) including a first bound member (18) and a second bound member (16) displaceable with respect to said first bound member (18) commonly with said medium outlet (19) for volumetrically varying said pressure chamber (12) with said discharge actuator.

2. The dispenser according to claim 1 and further including a guide body (53) for guiding the medium, wherein said guide body (53) is located entirely within said second dispenser unit (3), said second bound member (16) including an internal bound face extending over a length of said stroke path and being substantially stationary with respect to said medium outlet (15), said first bound member (18) including a displacer movable along said internal bound face for pressing the media out of said pressure chamber (12).

3. The dispenser according to claim 2 and further including a closure (19) for separating and communicating said pressure chamber (12) and said outlet duct (14), wherein said closure (19) is located directly upstream of said medium outlet (15), said outlet duct (14) including a nozzle duct bounded in one part by an end wall and ending in said medium outlet (15), said nozzle duct including an upstream end sealingly closed with said closure (19).

4. The dispenser according to claim 3, wherein said closure (19) includes a first closing face and a second closing face displaceable with respect to said first closing face for opening said closure (19), said second closing face including an annular edge which is inherently stiff and to be pressed against a wall inside of said end wall for closing said closure (19).

5. The dispenser according to claim 2 and further including venting means for automatically venting a medium reservoir (6) provided for recharging said pressure chamber (12) with the media, wherein said venting means include a venting duct bypassing said medium spaces (12, 14, 15) for environmentally venting the medium reservoir (6) through said first base body (4), antigerm means (40) being included for preventing bioactive germs to enter the medium reservoir (6), said venting duct traversing said antigerm means (40).

6. The dispenser according to claim 1, wherein said second base body (5) includes a guide projection (46) for guiding the media, said guide projection (46) being located inside said second base body (5) and freely projecting downstream inside a jacket (39), said jacket (39) being inherently stiff.

7. The dispenser according to claim 6, wherein said second bound member (16) includes a pump cylinder and said first bound member (18) includes a pump piston displaceable inside said pump cylinder (16) over said stroke path downstream up to an end position, said guide projection (46) bounding a chamber section of said pressure chamber (12), said chamber section connecting downstream to said pump cylinder (16) beyond said end position and being constricted with respect to said pump cylinder (16).

8. The dispenser according to claim 7 and further including a valve body (53) for closing and opening said pressure chamber (12) with respect to said outlet duct (14), wherein said guide projection includes a jacket projection (46) sealingly guiding said valve body (53).

9. The dispenser according to claim 8 and further including a handle (36) of said discharge actuator for displacing said second base body (5) with respect to said first base body (4) commonly with said medium outlet (15), wherein an outlet stud (7) projects freely over said handle (36) and is traversed by said medium outlet (15), said outlet stud (7) being freely exposed and inherently stiff, inside said outlet stud (7) said jacket projection (46) being located.

10. The dispenser according to claim 9, wherein said outlet stud (7) is a component separate from said second base body (5) but stationary with respect to said second base body (5) over said stroke path, said outlet stud (7) being inserted into said second base body (5) toward said handle (36), locking means (41) being included for non-rotationally locking said outlet stud (7) with respect to said second base body (5), said locking means including a snap connector (41).

11. The dispenser according to claim 1, wherein said first dispenser unit (2) includes a slide face for sealingly guiding said second bound member (16) outside said pressure chamber (12), said second dispenser unit (3) permanently projecting over said second bound member (16) counter said flow direction.

12. The dispenser according to claim 11 and further including a support wall (22) oriented transverse to said flow direction, wherein a guide jacket (32) freely projects from said support wall (22) counter to said flow direction and includes said slide face, said first base body (4) being traversed by an opening (69) covered with a seal (71) circumferentially supporting against said guide jacket (32).

13. The dispenser according to claim 1 and further including a stroke stop (47) for limiting said stroke path, wherein said first bound member (18) includes a sealing lip (62) sealingly guided on said second bound member (16) and separate from said stroke stop (47).

14. The dispenser according to claim 1, wherein said first bound member (18) includes a sealing lip (62) sealingly guided on said second bound member (16), said first bound member (18) including a guide lug (63) projecting downstream over said sealing lip (62) and bounding said pressure chamber (12).

15. The dispenser according to claim 1, wherein said first bound member (18) includes an appendix (27) provided to project inside a medium reservoir (6) when attached to said first base body (4).

16. The dispenser according to claim 1, wherein said first bound member (18) is a component separate from but rigidly connected with said first base body (4).

17. The dispenser according to claim 1, wherein at least one of said first and second base bodies (4, 5) includes first, second and third jackets (32, 33, 34 or 16, 35, 31) engaging the other base body (5, 4) when in said rest position, said jackets being inherently stiff, said third jacket (34 or 31) radially spacedly enveloping said second jacket (33 or 35) and said second jacket radially spacedly enveloping said first jacket (32 or 16).

18. The dispenser according to claim 1, wherein said first and second base bodies (4, 5) commonly include four innermost jackets (32, 33, 16, 35) freely projecting in opposing directions and including said second bound member (16), a spring (59) enveloping said innermost jackets.

19. The dispenser according to claim 1, wherein said first and second base bodies (4, 5) commonly bound a low pressure chamber located radially outside said pressure chamber (12).

20.The dispenser according to claim 1, wherein locking means (60) are included for preventing said base bodies (4, 5) from being pulled apart, said locking means (60) including a locking member (67) projecting over a sleeve (34) of said first base body (4) said sleeve (34) freely projecting downstream and including a free sleeve end, said locking member (67) being located upstream and spaced from said free sleeve end.

21. The dispenser according to claim 1 and further including an outlet valve (19) including a displaceable valve body (38, 57) and a valve seat, wherein said valve body is a mandrel (38, 57), a calming chamber being included for calming flow of the media, said calming chamber permanently communicating with said pressure chamber (12) and directly connecting to said valve seat.

22. The dispenser according to claim 1 and further including an outlet valve (19) including a valve seat and a valve body (38, 57) displaceable with respect to said valve seat for opening said outlet valve (19), wherein a driver (49) is included for engaging and mechanically opening said valve body (38, 57).

23. The dispenser according to claim 22, wherein a snap clutch (50) is included for connecting and disconnecting said driver (49) with said valve body (38, 57) upon actuating said discharge actuator.

24. The dispenser according to claim 1 and further including a connector (30) for tensioning one of said first and second base bodies (4) against a media reservoir (6), wherein said connector (30) is a component separate from said one base body (4), said connector (30) including a fastener (26) for directly engaging the medium reservoir (6) and for connecting said connector (30) to the medium reservoir (6) independent from said dispenser (1), said connector (30) including a positioning lock (26*a*) for rigidly connecting said dispenser (1) with said connector (30) independent from the medium reservoir (6).

25. The dispenser according to claim 24, wherein said connector (30) includes a connector cap for overengaging a reservoir neck of the medium reservoir (6), said connector (30) including a riser tube (24) for transferring the media out of the medium reservoir (6) and into said pressure chamber (12).

26. The dispenser according to claim 24, wherein said connector (30) includes inner and outer circumferences, said positioning lock (26*a*) being located on said outer circumference.

* * * * *